United States Patent [19]

Ramberg

[11] Patent Number: 4,723,819

[45] Date of Patent: Feb. 9, 1988

[54] MERCHANDIZING DEVICE

[75] Inventor: Rodney G. Ramberg, Minneapolis, Minn.

[73] Assignee: Shoe Spa Inc., Minneapolis, Minn.

[21] Appl. No.: 873,699

[22] Filed: Jun. 12, 1986

[51] Int. Cl.[4] ..... A47F 3/10

[52] U.S. Cl. ..... 312/130; 312/223; 312/309; 211/129; 211/144; 211/163

[58] Field of Search ..... 108/107; 312/210, 222, 312/203, 223, 125, 135, 250, 309, 130; 211/34–37, 131, 129, 144, 163, 208, 189, 162, 94, 187

[56] References Cited

U.S. PATENT DOCUMENTS

| | | | |
|---|---|---|---|
| 459,537 | 2/1891 | Stickney . | |
| 634,387 | 9/1899 | Betcone . | |
| 2,082,088 | 7/1937 | Wilson . | |
| 2,613,735 | 7/1952 | Fisher . | |
| 2,928,704 | 3/1960 | Rappaport | 312/201 X |
| 2,941,659 | 6/1960 | Thrower et al. . | |
| 3,069,216 | 12/1962 | Vaeth | 211/186 X |
| 3,437,389 | 4/1969 | Perkins et al. | 312/202 |
| 3,552,576 | 11/1971 | Lahr . | |
| 3,631,821 | 1/1972 | Zachariou | 211/187 X |
| 3,844,230 | 10/1974 | Hudson et al. | 211/163 X |
| 3,887,786 | 6/1975 | Witt et al. | 211/163 X |
| 4,008,807 | 4/1977 | Phillips . | |

*Primary Examiner*—Joseph Falk

*Attorney, Agent, or Firm*—Peterson, Wicks, Nemer & Kamrath

[57] ABSTRACT

A merchandizing device is shown in the preferred form according to the teachings of the present invention as including a display portion for displaying a plurality of one half pairs of products and a storage portion associated with the display portion for storing all of the mates of the one half pairs of products displayed in the display portion. The display portion includes a frame including a rectangular back portion and isosceles trapezoid-shaped top and bottom portions for rotatably mounting three shelf units arranged in a clearing, triangular configuration. Each of the shelf units include vertically arrayed, horizontal, adjustable shelves. The storage portion is shown in the preferred form as first and second cabinets movable between a first position behind the display portion such that the display portion prevents access to the interior of the cabinets and a second position located to the side of the display portion allowing access to the cabinets' interiors. In the preferred embodiment, the cabinets are movable by rollers and by drawer glides mounted to the cabinets and the display portion.

23 Claims, 3 Drawing Figures

MERCHANDIZING DEVICE

BACKGROUND

The present invention relates generally to merchandising products, particulary to displaying products that are normally sold in pairs such as footwear, and specifically for displaying a plurality of one half pairs of products and for storing the mates of the plurality of one half pairs of products in a contained unit.

With the advent of self-service type, discount stores, a need has arisen for displaying merchandise which allows the consumer to easily find and select the desired merchandise without supervision of store clerks while substantially preventing theft of the merchandise as the result of lack of store supervision. Likewise, in self-service as well as semi-self service and full-service stores, a need has arisen for displaying merchandise which increases the productivity of store personnel. Furthermore, such display units should maximize the amount of merchandise on display while minimizing the retail space requirements.

SUMMARY

The present invention solves these and other needs in merchandising by providing, in the preferred embodiment, a merchandising device including a display portion for displaying a plurality of one half pairs of products and a storage portion for storing the mates of the plurality of one half pairs of products displayed in the display portion. The display portion includes first, second, and third shelf units rotatably mounted about spaced, vertical axes arranged in a triangular configuration and arranged to clear one another when rotated about their vertical axes. The shelf units each include vertically arrayed shelves arranged perpendicular to the vertical axes of the shelf units allowing double-sided display of the one half pairs of products located on the shelves. The merchandising device maximizes the products displayed while minimizing the sales space required.

It is thus an object of the present invention to provide a novel merchandising device.

It is further an object of the present invention to provide such a novel merchandising device which displays one half pairs of a plurality of products and stores the mates of the one half pairs displayed in a contained unit.

It is further an object of the present invention to provide such a novel merchandising device which increases productivity.

It is further an object of the present invention to provide such a novel merchandising device which maximizes the amount of products on display while minimizing retail space requirements.

It is further an object of the present invention to provide such a novel merchandising device allowing the consumer to easily find and select the desired merchandise.

It is further an object of the present invention to provide such a novel merchandising device which substantially prevents theft.

It is further an object of the present invention to provide such a novel merchandising device which increases impulse purchasing.

It is further an object of the present invention to provide such a novel merchandising device which aids in attracting the consumer's attention.

It is further an object of the present invention to provide such a novel merchandising device which reduces operating costs.

It is further an object of the present invention to provide such a novel merchandising device which is useable in self-service, semi-self service, and full-service store operations.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
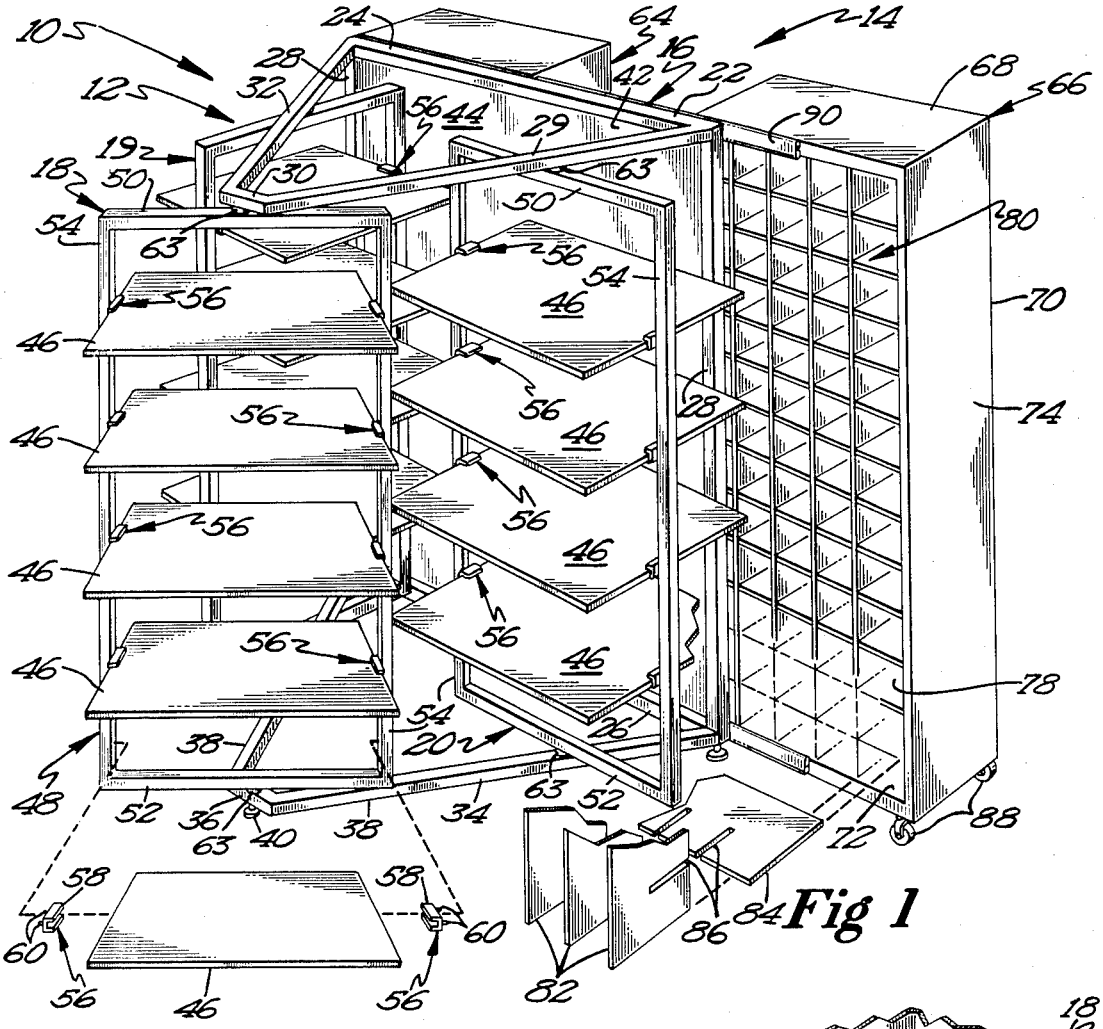
FIG. 1 shows a perspective view of a preferred form of a contained display and inventory unit according to the teachings of the present invention.
Figure 2:
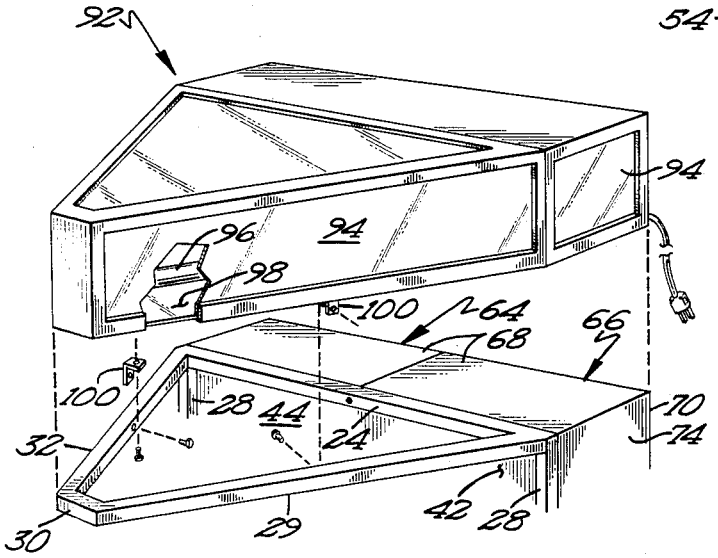
FIG. 2 shows a perspective view of a lighting and advertising display portion of the contained display and inventory unit of FIG. 1.
Figure 3:
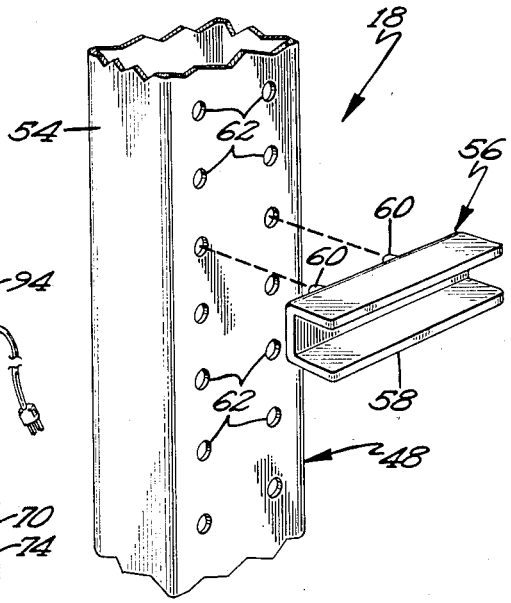
FIG. 3 shows a partial, enlarged perspective view of the contained display and inventory unit of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "upper", "lower", "first", "second", "inside", "outside", and similar terms are used herein, it should be understood that these terms have reference only to the structure shown in the drawings as it would appear to a person viewing the drawings and are utilized only to facilitate describing the invention.

DESCRIPTION

A preferred form of a merchandising device according to the teachings of the present invention is shown in the drawings as a contained display and inventory unit and generally designated 10. In the preferred form, unit 10 is utilized to merchandise products that are normally sold to consumers in pairs such as footwear, where one of the pair (one half pair) is displayed to the consumer and the other of the pair (the mate of the one half pair) is maintained in inventory. The purpose of displaying only one of the pair is to maximize the number of product types and styles on display while reducing the possibility of theft since only one half of the product is accessible to the consumer.

In the preferred form of the present invention, unit 10 generally includes a display portion 12 and a storage portion 14. In the most preferred form of the present invention, display portion 12 is generally triangular in configuration and generally includes a frame 16 which rotatably mounts three shelf units 18–20. Frame 16 generally includes a back portion 22 having a generally rectangular shape including a top rail 24 and a bottom rail 26 having their ends interconnected by side rails 28. Frame 16 further includes a top portion 29 having a generally triangular configuration and particularly is in the form of an isosceles trapezoid including a front rail 30 which is generally parallel to and of a length significantly shorter than top rail 24 and side rails 32 extending between the ends of rails 30 and 24. Frame 16 further includes a bottom portion 34 having a generally triangular configuration indentical to top portion 29 and particularly is in the form of an isosceles trapezoid including a lower rail 36 which is generally parallel to and of a length significantly shorter than bottom rail 26 and side rails 38 extending between the ends of rails 26 and 36. In the most preferred form, suitable members 40 such as legs are provided to support frame 16 in a generally spaced condition above the showroom floor or other surface. Thus, legs 40 support display portion 12 on the floor such that no retail wall space is wasted. In its most preferred form, frame 16 includes a panel 42 secured to back portion 22 on the side opposite to top and bottom portions 29 and 34. Face 44 of panel 42 located in back portion 22 may be mirrored or provide an advertising surface of the products being merchanized in unit 10. In the most preferred form, arrangements are made to have panel 42 and/or face 44 interchangeable to allow changing the merchandising environment of display portion 12.

In the most preferred form of the present invention, shelf units 18–20 generally comprise vertically arrayed shelves 46 which are adjustably supported in a framework 48. Framework 48 is generally rectangular in shape and includes a top arm 50 and a bottom arm 52 having their ends interconnected by upright arms 54. Shelves 46 are demountable attached between upright arms 54 by members 56 shown in their preferred forms as trough shaped members 58 which are received on the opposite sides of shelves 46 and may be removably positioned along upright arms 54. In the most preferred form, members 58 include pin members 60 which are removably received in one of a complementary set of an array of apertures 62 arranged longitudinally along upright arms 54.

Shelf unit 18 is rotatably mounted in frame 16 by spindles 63 extending between the intermediate points of front rail 30 and top arm 50 and of lower rail 36 and bottom arm 52. Shelf units 19 and 20 are rotatably mounted in frame 16 by spindles 63 extending between the intermediate points of side rails 32 and top arm 50 and of side rails 38 and bottom arm 52. Thus, shelf units 18–20 are arranged to be rotatable about vertical axes, with the axes being perpendicular to shelves 46 of shelf units 18–20. In the preferred form, shelf units 18–20 are arranged to clear one another when they are rotated in frame 16.

In the preferred form of the present invention, storage portion 14 generally includes first and second storage cabinets 64 and 66. Cabinets 64 and 66 in their most preferred form have a height generally equal to the height of display portion 12 and a width generally equal to one half of the width of panel 42 of frame 16. Generally, cabinets 64 and 66 include a closed top 68, a closed back 70, a closed bottom 72, closed sides 74, and an open front 78 defining an interior. To allow storage of footwear in individual bags and relieving the need for boxes, compartment inserts 80 are removably received in the interiors of cabinets 64 and 66 and generally include vertical dividers 82 and horizontal dividers 84. Dividers 82 and 84 include complementary slots 86 extending one half the length of dividers 82 and 84 so that they may be interfitted to form insert 80 defining a plurality of individual compartments. It should then be noted that with insert 80 received in the interiors of cabinets 64 and 66 in a manner as shown in the exploded version of dividers 82 and 84 of FIG. 1, vertical dividers 82 can be removably arranged to provide for individual compartments of varing sizes to accomodate various size products such as loafers and boots. Likewise, due to the removable nature of insert 80, insert 80 may be reversed in position from the exploded version of FIG. 1 such that horizontal dividers 84 can be removably arranged to provide for individual compartments of varying sizes to accomodate various size products such as loafers and boots.

In the preferred form of the present invention, cabinets 64 and 66 are movable between a first position located behind display portion 12 such that panel 42 closes open front 78 of cabinets 64 and 66 and a second position located to the side of display portion 12 such that access is permitted in the interior of cabinets 64 and 66. In FIG. 1, cabinet 64 is shown as located in the first, closed access position and cabinet 66 is shown as located in the second, open access position. In the most preferred form, cabinets 64 and 66 are provided with rollers 88 for rollable support on the showroom floor or other surface. Furthermore, in the most preferred form, cabinets 64 and 66 are movably mounted to display portion 12 such as by drawer type glides 90 mounted on panel 42 along rails 24 and 26 of display portion 12 and on the edges of top and bottom 68 and 72 defining open front 78 of cabinets 64 and 66. It should then be noted that units 10 are very stable and are free standing and are not prone to shifts in weight as the result of movement of cabinets 64 and 66 according to the teachings of the present invention.

In the preferred form of the present invention, unit 10 further generally includes lighting and advertising display portion 92 having a configuration substantially the same as the top of display and storage portions 12 and 14 with cabinets 64 and 66 in their first, closed access positions. Generally, portion 92 includes six sides 94 having a length generally equal to front rail 30, side rails 32 of frame 16, sides 74 of storage portion 14, and the combined length of backs 70 of cabinets 64 and 66 of storage portion 14. Sides 94 are adaptable to removably receive signs including suitable advertising for the products being merchandised in unit 10. Suitable lighting 96 can be provided such as florescent tubes in the interior of portion 92 for providing illumination of the signs located in sides 94 of portion 92. To allow placement of unit 10 in low light or unlighted areas and to illuminate the products displayed in portion 12, the bottom of portion 92 can be equipped with paracube or parahex lenses 98 to allow light from florescent tubes 96 to pass therethrough. Suitable attachment members 100 can be provided to secure portion 92 to portion 12 of unit 10 such as L-shaped brackets attached to portions 12 and 92.

Now that the construction of contained display and inventory unit 10 according to the preferred form of the present invention has been set forth, the operation and subtle features of the present invention can be set forth and appreciated. Usually when displaying footwear, one half of a pair is displayed on a selling floor sales area while the other half of that pair or its mate is kept in a storage room at some distance. This practice leads to wasted time going back and forth for personnel and inconvenience to the consumer. By placing storage portion 14 immediately behind display portion 12 according to the teachings of the present invention, unit 10 saves time, space and labor for both the consumer and retailer.

It should be noted that the rotatability of shelf units 18–20 according to the teachings of the present invention is further advantageous. Specifically, shelf units 18–20 allow for two-sided display and can thus hold double the amount of merchandise of single-sided display fixtures. For example, with shelves 46 having a size of 16 inches by 19 inches, four half pairs of footwear can be displayed on one side of shelf 46 and four additional half pairs of footwear can be displayed on the other side of shelves 46. It is then only necessary to rotate shelf units 18–20 in frame 16 to allow viewing of both display sides of shelf units 18–20.

In its most preferred form, shelf units 18–20 include twelve shelves 46 spaced 6 inches vertically apart such that 96 half pairs of footwear can be displayed in each shelf unit 18–20. Thus, the rotatability of shelf units 18–20 substantially reduces space requirements. Furthermore, unit 10 includes three shelf units 18–20 in the most preferred form allowing the display of 288 half pairs of footwear. Further, the triangular configuration of shelf units 18–20 maximizes the utilization of floor space reducing space requirements while maximizing display.

Further, since access is allowed through fronts 78 of cabinets 64 and 66 of unit 10 according to the preferred form of the present invention, unit 10 can be placed against a wall such that backs 70 of cabinets 64 and 66 are parallel and adjacent thereto such that retail space requirements are further minimized.

It should also be appreciated that having storage portion 14 movable with respect to display portion 12 in a manner such as unit 10 of the preferred form of the present invention allows for advantageous arrangement of a plurality of units 10 while maximizing retail space. For example, two units 10 can be arranged with backs 70 of storage portions 14 of units 10 in a generally abutting arrangement. Likewise, three units 10 can be arranged in a U-shaped arrangement, with the area within the units 10 being utilized as space for additional storage and/or desk and counter space. In the preferred form, backs 70 of units 10 forming the legs of the U-shaped arrangement extend generally at an angle of less than 90° from the back 70 of unit 10 forming the central portion of the U-shaped arrangement for ease of mobility of cabinets 64 and 66. Similarly, four units can be arranged around a square space having sides generally equal to the width of units 10, with the square space being utilized for additional storage. It can then be appreciated that unit 10 according to the teachings of the present invention is particularly adaptable to various arrangements which maximize display and merchandising while minimizing space requirements.

It can then be appreciated that unit 10 according to the teachings of the present invention results in synergistic reduction of retail space requirements of 60 to 70 percent. Specifically, unit 10 according to the preferred form of the present invention utilizes only 10 square feet of floor space while storing and displaying 288 pairs of footwear. By reducing retail space requirements, operating costs are reduced in both square foot rents and other applicable real estate costs.

In the most preferred form, shelf units 18–20 are arranged and marked by footwear size and category such that the consumer can easily find wanted merchandise, increasing impulse purchasing. Furthermore ease of selection or rejection by the consumer is obtained because all inventory is displayed. Furthermore, each compartment of cabinets 64 and 66 is assigned a location number for ease of finding the mates of the one half pair displayed in display portion 12. Therefore, sales losses due to misplaced merchandise is substantially prevented. Likewise, the long trips to a separate storage room to determine if merchandise of the desired size or the like is available and/or to obtain the other half of the displayed merchandise are substantially eliminated since all products are displayed and stored in contained unit 10 according to the teachings of the present invention.

It can then be appreciated that unit 10 according to the teachings of the present invention results in increased productivity in the range of at least three times per square foot of retail space.

Further, the attention of the consumer is attracted, and thus the turnover of the products displayed is increased as the result of the construction of unit 10 according to the teachings of the present invention. Particularly, the rotation of shelf units 18–20 will aid in attracting attention to unit 10. Mirrors attached to panel 42 give proximity for consumer use. Likewise, consumers are quickly guided to wanted merchandise by signs located in sides 94 of lighting and advertising display portion 92, by signs attached to rotating shelf units 18–20, and/or by signs located on panel 42. Furthermore, the consumer will be attracted to unit 10 by the large quantity of merchandise displayed in a relatively small space in an uncluttered manner.

Now that the basic teachings of the present invention have been explained, many extensions and variations will be obvious to one having ordinary skill in the art. For example, it can then be appreciated that display portion 12 can be used independently from storage portion 14 as a functional store fixture. For example, display portion 12 can be utilized in a manner similar to prior practices where the other half of the displayed half pair was kept at a remote storage room.

Likewise, although in the preferred form, storage portion 14 of unit 10 according to the teachings of the present invention is formed from two separate cabinets 64 and 66 and is believed to be particularly advantageous, it should be noted that storage portion 14 may have other constructions such as a single cabinet according to the teachings of the present invention. Further, although in the preferred form access is allowed to the interiors of storage portion 14 by the movability of cabinets 64 and 66 with respect to display portion 12, other methods of access can be provided according to the teachings of the present invention such as fixing storage portion 14 to display portion 12 and providing doors in storage portion 14. Furthermore, in the preferred form, inserts 80 are provided in storage portion 14 to define a plurality of individual compartments for storing the mate of the half pair displayed, other methods of arranging and storing the mate of the half pair displayed can be utilized according to the teachings of the present invention such as but not limited to permanently formed compartments or other storage members.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for merchandising a plurality of products that are normally sold to consumers in pairs, with the pairs including a one half pair and a mate to the one half pair, comprising, in combination: a display portion for displaying all of the plurality of one half pairs of products; a storage portion associated with the display portion for storing all of the plurality of the mates to the one half pairs of products; with the display portion comprising, in combination: a first shelf unit including vertically arranged shelves; a second shelf unit including vertically arranged shelves; a third shelf unit including vertically arranged shelves, with each of the shelves of the first, second, and third shelf units holding a multiplicity of one half pairs of the products; a frame having a back portion, a top portion, and a bottom portion, with the back portion having a generally rectangular shape including a top rail and a bottom rail having their ends interconnected by side rails, with the top portion being in the form of an isosceles trapezoid including a front rail having ends and side rails extending between the ends of the front rail and the top rail, with the front rail being parallel to and of a length significantly shorter than the top rail of the back portion, with the bottom portion being in the form of an isosceles trapezoid of an identical size and shape as the top portion including a lower rail having ends and side rails extending between the ends of the lower rail and the bottom rail, with the lower rail being parallel to and of a length significantly shorter than the bottom rail of the back portion; first means for rotatably mounting the first shelf unit about a vertical axis extending between intermediate points of the front and lower rails of the top and bottom portions of the frame; second and third means for rotatably mounting the second and third shelf units about vertical axes extending between intermediate points of the side rails of the top and bottom portions of the frame, with the vertical axes of the shelf units being perpendicular to the shelves of the shelf units and being located with respect to the shelves of the shelf unit enabling double-sided display of the one half pairs of products located on the shelves when the shelf units are rotated about the vertical axes, with the vertical axes of the first, second, and third shelf units being arranged in a triangular configuration with the shelf units arranged to clear one another when rotated about their vertical axes to reduce the sales space required by the display portion; and a panel secured to the back portion of the frame; and with the storage portion comprising at least a first cabinet, with the cabinet comprising, in combination: a closed top, a closed back, a closed bottom, closed sides, and an open front defining an interior; means located in the interior of the cabinet for storing the plurality of the mates to the one half pairs of products in an arrangement; and means for moving the cabinet between first and second positions, wherein in the first position the panel of the back portion of the frame of the display portion closes the open front of the cabinet to prevent access to the interior of the cabinet and in the second position access to the cabinet is allowed through the open front of the cabinet into the interior of the cabinet.

2. The merchandising device of claim 1 wherein the moving means comprises, in combination: rollers secured to the cabinet for rollable support of the cabinet.

3. The merchandising device of claim 1 wherein the moving means comprises, in combination: drawer glides mounted on the display portion and mounted on the cabinet.

4. The merchandising device of claim 1 wherein the storing means comprises a compartment insert removably received in the interior of the cabinet, with the compartment insert comprising, in combination: a plurality of vertical dividers and a plurality of horizontal dividers; and means for interfitting the vertical and horizontal dividers to define individual compartments, with the interfitting means being removeable to provide for individual compartments of varying sizes to accommodate various size mates of the products.

5. The merchandising device of claim 1 wherein the shelf units comprise, in combination: a framework having a generally rectangular shape and including a top arm and a bottom arm having their ends interconnected by first and second upright arms; and means for demountably attaching the array of shelves in a vertically spaced condition between the upright arms of the framework.

6. The merchandising device of claim 1 further comprising, in combination: a lighting and advertising display portion for receipt on and connection to the display portion, with the lighting and advertising display portion including means for removably receiving signs including advertising for the products merchandised in the device; and means for providing illumination of the signs.

7. The merchandising device of claim 6 wherein the lighting and advertising display portion includes a bottom and an interior; with the illumination providing means comprising light bulbs located in the interior of the lighting and advertising display portion; and wherein the bottom of the lighting and advertising display portion includes lenses to allow light to pass therethrough for illuminating the half pairs of products displayed in the display portion.

8. Device for merchandising a plurality of products that are normally sold to consumers in pairs, with the pairs including a one half pair and a mate to the one half pair, comprising, in combination: a display portion comprising means for for displaying all of the plurality of one half pairs of products and an access prevention means; a storage portion associated with the display portion for storing all of the plurality of the mates to the one half pairs of products; wherein the storage portion comprises at least a first cabinet, with the cabinet comprising, in combination: a closed top, a closed back, a closed bottom, closed sides, and an open front defining an interior; means located in the interior of the cabinet for storing the plurality of the mates to the one half pairs of products in an arrangement; and means for the cabinet movably interconnecting with respect to the means for displaying between first and second positions wherein in the first position the access prevention means of the means for displaying prevents access to the interior of the cabinet through the open front and in the second position access to the cabinet is allowed through the open front of the cabinet into the interior of the cabinet.

9. The merchandising device of claim 8 with the display portion comprising, in combination: a first shelf unit including vertically arranged shelves; a second shelf unit including vertically arranged shelves, with each of the shelves of the first and second shelf units holding a multiplicity of one half pairs of the products; means for rotatably mounting the first and second shelf units to the display portion about spaced vertical axes, with the vertical axes of the shelf units being perpendicular to the shelves of the shelf units and being located with respect to the shelves of the shelf unit enabling double-sided display of the one half pairs of products located on the shelves when the shelf units are rotated about the vertical axes.

10. The merchandising device of claim 9 wherein the shelf units comprise, in combination: a framework; and means for demountably attaching the array of vertically arranged shelves in the framework, with the rotatably mounting means comprising means for rotatably mounting the framework of the first and second shelf units to the display portion.

11. The merchandising device of claim 9 further comprising, in combination: a lighting and advertising display portion for receipt on and connection to the display portion, with the lighting and advertising display portion including means for removably receiving signs including advertising for the products merchandised in the device; and means for providing illumination of the signs.

12. The merchandising device of claim 11 wherein the lighting and advertising display portion includes a bottom and an interior; with the illumination providing means comprising light bulbs located in the interior of the lighting and advertising display portion; and wherein the bottom of the lighting and advertising display portion includes lenses to allow light to pass therethrough for illuminating the half pairs of products displayed in the display portion.

13. The merchandising device of claim 9 wherein the rotatably mounting means comprises means for rotatably mounting the first and second shelf units for 360° rotation around the spaced vertical axes.

14. The merchandising device of claim 8 wherein the movably interconnecting means comprises, in combination: rollers secured to the cabinet or rollable support of the cabinet.

15. The merchandising device of claim 14 wherein the movably interconnecting means comprises, in combination: drawer glides mounted on the display portion and mounted on the cabinet.

16. The merchandising device of claim 8 wherein the storing means comprises a compartment insert removably received in the interior of the cabinet, with the compartment insert comprising, in combination: a plurality of vertical dividers and a plurality of horizontal dividers; and means for interfitting the vertical and horizontal dividers to define individual compartments, with the interfitting means being removable to provide for individual compartments of varying sizes to accommodate various size mates of the products.

17. Device for merchandising a plurality of products that are normally sold to consumers in pairs, with the pairs including a one half pair and a mate to the one half pair, comprising, in combination: a display portion for displaying all of the plurality of one half pairs of products; a storage portion associated with the display portion for storing all of the plurality of the mates to the one half pairs of products; with the display portion comprising, in combination: a first shelf unit including vertically arranged shelves, with each of the shelves of the first shelf unit holding a multiplicity of one half pairs of the products; means for rotatably mounting the first shelf unit to the display portion about a vertical axis, with the vertical axis of the shelf unit being perpendicular to the shelves of the shelf unit and being located with respect to the shelves of the shelf unit enabling double-sided display of the one half pairs of products located on the shelves when the shelf unit is rotated about the vertical axis; wherein the shelf unit comprises, in combination: a framework; and means for demountably attaching the array of vertically arranged shelves in the framework, with the rotatably mounting means comprising means for rotatably mounting the framework of the first shelf unit to the display portion; wherein the framework is generally rectangular in shape and includes a top arm and a bottom arm having their ends interconnected by first and second upright arms; wherein the demountably attaching means comprises means for demountably attaching the array of vertically arranged shelves in a vertically spaced condition between the upright arms of the framework.

18. The merchandising device of claim 17 wherein the demountably attaching means comprises, in combination: an array of sets of apertures arranged longitudinally along the upright arms; and members received on the shelves including means for removable receipt in one of the array of aperture sets.

19. The merchandising device of claim 17 wherein the rotatable mounting means further comprises, in combination: a first spindle located intermediate the ends and extending from the top arm of the framework of the shelf units; and a second spindle located intermediate the ends and extending from the bottom arm of the framework of the shelf units.

20. Device for merchandising a plurality of products that are normally sold to consumers in pairs, with the pairs including a one half pair and a mate to the one half pair, comprising, in combination: a display portion for displaying all of the plurality of one half pairs of products; a storage portion associated with the display portion for storing all of the plurality of the mates to the one half pairs of products; with the display portion comprising, in combination: a first shelf unit including vertically arranged shelves; a second shelf unit including vertically arranged shelves; a third shelf unit including vertically arranged shelves, with each of the shelves of the first, second, and third shelf units holding a multiplicity of one half pairs of the products; means for rotatably mounting the first, second, and third shelf units to the display portion about spaced vertical axes, with the vertical axes of the shelf units being perpendicular to the shelves of the shelf units and being located with respect to the shelves of the shelf unit enabling double-sided display of the one half pairs of products located on the shelves when the shelf units are rotated about the vertical axes, with the vertical axes of the first, second, and third shelf units being arranged in a triangular configuration with the shelf units arranged to clear one another when rotated about their vertical axes to reduce the sales space required by the display portion; wherein the rotatably mounting means comprises, in combination: a frame having a back portion, a top portion, and a bottom portion, with the back portion having a generally rectangular shape including a top rail and a bottom rail having their ends interconnected by side rails, with the top portion being in the form of an isosceles trapezoid including a front rail having ends and side rails extending between the ends of the front rail and the top rail, with the front rail being parallel to and of a length significantly shorter than the top rail of the back portion, with the bottom portion being in the form of an isosceles trapezoid of an identical size and shape as the top portion including a lower rail having ends and side rails extending between the ends of the lower rail and the bottom rail, with the lower rail being parallel to and of a length significantly shorter than the bottom rail of the back portion, with the vertical axis of the first shelf unit extending between intermediate points of the front and lower rails of the top and bottom portions of the frame, with the vertical axes of the second and third shelf units extending between intermediate points of the side rails of the top and bottom portions of the frame.

21. The merchandising device of claim 20 further comprising, in combination: a panel secured to the back portion of the frame; and wherein the storage portion comprises at least a first cabinet, with the cabinet comprising, in combination: a closed top, a closed back, a closed bottom, closed sides, and an open front defining an interior; means located in the interior of the cabinet for storing the plurality of the mates to the one half pairs of products in a arrangement; and means for moving the cabinet between first and second positions, wherein in the first position the panel of the back portion of the frame of the display portion closes the open front of the cabinet to prevent access to the interior of the cabinet and in the second position access to the cabinet is allowed through the open front of the cabinet into the interior of the cabinet.

22. The merchandising device of claim 21 wherein the moving means comprises, in combination: rollers secured to the cabinet for rollable support of the cabinet.

23. The merchandising device of claim 8 wherein the display portion further comprises, in combination: a third shelf unit including vertically arranged shelves, with each of the shelves of the third shelf unit holding a multiplicity of one half pairs of the products; means for rotatably mounting the third shelf unit to the display portion about a vertical axis spaced from the vertical axis of the first and second shelf units, with the vertical axis of the third shelf unit being perpendicular to the shelves of the third shelf unit and being located with respect to the shelves of the third shelf unit enabling double-sided display of the one half pairs of products located on the shelves when the third shelf unit is rotated about the vertical axis, with the vertical axes of the first, second, and third shelf units being arranged in a triangular configuration with the shelf units arranged to clear one another when rotated about their vertical axes to reduce the sales space required by the display portion.

* * * * *